United States Patent [19]

Piégay

[11] 4,438,946

[45] Mar. 27, 1984

[54] SLALOM SKI WITH VIBRATION DAMPER

[75] Inventor: Yves Piégay, Voiron, France

[73] Assignee: Skis Rossignol S.A., Voiron, France

[21] Appl. No.: 366,357

[22] Filed: Apr. 7, 1982

[30] Foreign Application Priority Data

Apr. 9, 1981 [FR] France ..... 81 07519

[51] Int. Cl.[3] ..... A63C 5/00

[52] U.S. Cl. ..... 280/602; 280/610

[58] Field of Search ..... 280/601, 602, 610

[56] References Cited

U.S. PATENT DOCUMENTS

| | | | |
|---|---|---|---|
| 3,537,717 | 11/1970 | Caldwell | 280/602 |
| 3,844,576 | 10/1974 | Schultes | 280/610 |
| 3,901,522 | 8/1975 | Boehm | 280/610 |

FOREIGN PATENT DOCUMENTS

| | | |
|---|---|---|
| 337581 | 7/1977 | Austria . |
| 1960408 | 6/1971 | Fed. Rep. of Germany . |
| 2025877 | 9/1970 | France . |
| 2237653 | 2/1975 | France . |
| 2237654 | 2/1975 | France . |
| 2437225 | 4/1980 | France . |

*Primary Examiner*—Joseph F. Peters, Jr.
*Assistant Examiner*—Kenneth R. Rice
*Attorney, Agent, or Firm*—Karl F. Ross

[57] ABSTRACT

A slalom ski includes in the structure of its body a stressed viscoelastic band extending from about the middle of its tread zone forward over a length equaling 15% to 30% that of the ski body.

4 Claims, 3 Drawing Figures

SLALOM SKI WITH VIBRATION DAMPER

FIELD AND BACKGROUND OF THE INVENTION

My present invention relates to a ski.

In all conditions of motion on snow (longitudinal movement, skidding, turning . . . ) a ski is subject to vibratile phenomena which are the larger the higher the speed and the harder the snow. These vibrations, which bring about interruptions in the contact between the ski and the snow, lead to a directional instability and to a reduction in the adherence to hard snow; moreover, they impair the comfort of the skier.

In order to improve the performance and the comfort, it has already been proposed to damp the vibrations; for this purpose the idea has been conceived to incoporate in the ski structure, over its entire length, a band of viscoelastic material. Such skis have been described for example in U.S. Pat. Nos. 3,844,576 and 3,901,522; they actually provide good comfort but lack vivacity, are slow and perform on hard snow in a not entirely satisfactory manner.

Starting with this state of the art, I have carried out studies and investigations which have led to the conclusion that not all vibrations of a ski are harmful and that, while some of them require damping or partial elimination, others should be preserved; thus, in my commonly owned U.S. patent application Ser. No. 257,114 filed Apr. 24, 1981, now U.S. Pat. 4,405,149, there have been described and claimed skis which, thanks to the positioning and the dimensional relationship of the damping elements of the aforementioned type, are suitable for particular modes of use, namely for a vacation ski and a giant-slalom ski.

OBJECT OF THE INVENTION

The object of my present invention is to provide an arrangement of the same general type having particular utility for a slalom ski.

SUMMARY OF THE INVENTION

Taking into consideration the fact that the vibrations of a ski result essentially from the addition of three elemental vibrations of which one or the other preponderates according to the exercises (skidding turns of short radii, broken turns of long radii), I have determined the distribution of the energy generated by the vibrations, on the one hand, as a function of their frequency and, on the other hand, along the ski in its longitudinal direction.

FIGS. 1 and 2 of the annexed drawing illustrate corresponding curves in the case of a slalom ski. It follows from FIG. 1 that the vibrations which are the most frequent and the strongest, represented by a peak a, occur at a frequency of about 20 Hz while two lesser peaks b and c appear near 40 and 60 Hz. As shown in FIG. 2, it is ahead of the tread zone 4—i.e. between the tip zone 2 of the ski and the position of the boot—that the energy of these vibrations is essentially localized.

In order to solve the problem of vibrations of a slalom ski, an arrangement according to my invention provides within the structure of the ski a band of stressed viscoelastic material which has a length ranging substantially between 15 and 30% of the length of the body of the ski and is disposed in a position bridging the boot-supporting zone of the tread 4 and the intermediate zone separating the tread zone from the tip zone 2.

SPECIFIC DESCRIPTION

Figure 1:
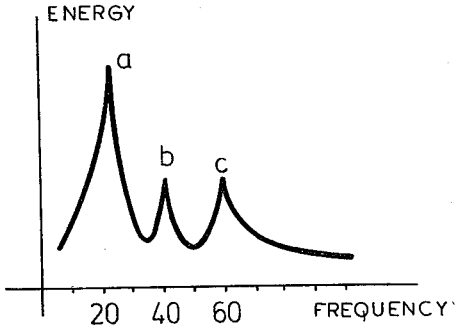
FIGS. 1 and 2 are two curves already described.
Figure 2:
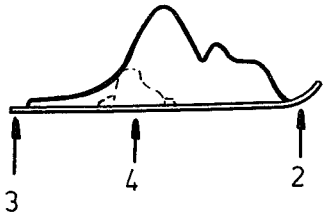
Figure 3:
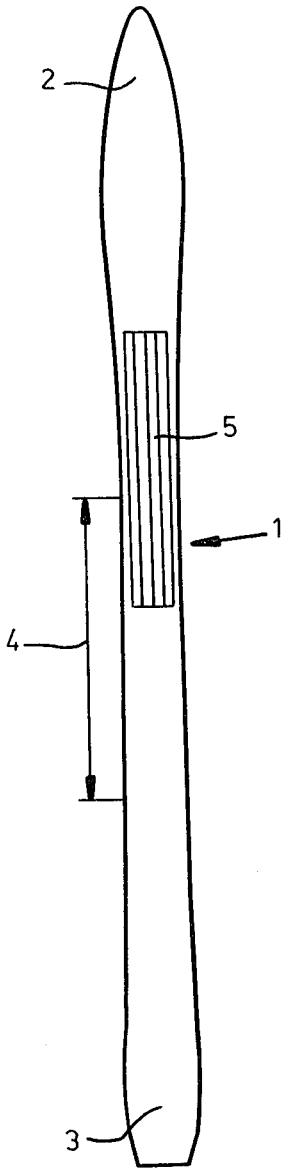
FIG. 3 illustrates, in plan view from above, a slalom ski embodying my invention.

The ski 1 shown in the drawing has the tip and tread zones 2, 4 already referred to, as well as a heel 3. According to my invention this ski comprises a single damping element 5 which extends from a forward part of the tread zone 4 toward the tip zone 2. This damping element consists of a band of stressed viscoelastic material which, for the sake of clarity of the drawing, is represented in full lines but in fact is placed in the interior of the ski structure. This band 5 starts substantially at the middle of the tread zone 4 and terminates short of the tip zone 2.

The length of this band is for example 45 cm for a ski whose length ranges from 2 meters to 2.05 meters; in that case the longitudinal positioning of the band 5 in the ski is such that its rear and front extremities are respectively disposed at 92 cm and at 137 cm from the heel 3. Thus, the distance of that front extremity from the forward end of the ski body is at least 63 cm, well in excess of the length of the band itself.

Thanks to the utilization, the dimensions and the positioning of its single damping element, the slalom ski according to my invention is superior to the usual slalom skis since it combines the following advantages:

an excellent lateral adherence enabling not only very good canting engagements but also very effective canting re-engagements, a very great turning precision, and a remarkably soft and comfortable ride regardless of the configuration and consistency of the snow, particularly on account of the sharp reduction of the usual chattering phenomena.

I claim:

1. A slalom ski having a body with a tip zone, a heel and a boot-supporting tread zone, said body having a structure incorporating in its interior a band of stressed viscoelastic material of a length ranging substantially between 15% and 30% of the length of said body, said band extending from substantially the middle of said tread zone toward said tip zone and terminating short of the latter.

2. A slalom ski as defined in claim 1 wherein said band is spaced from the front end of said body by more than the length of said band.

3. A slalom ski as defined in claim 2 wherein said body has a length ranging between substantially 2 and 2.05 meters, said band having a length of about 45 cm.

4. A slalom ski as defined in claim 3 wherein said band has rear and front extremities respectively spaced by substantially 92 cm and 137 cm from said heel.

* * * * *